United States Patent [19]

Straitz, III

[11] 4,174,201

[45] Nov. 13, 1979

[54] BURNER HEADS FOR WASTE COMBUSTIBLE GAS

[75] Inventor: John F. Straitz, III, Meadowbrook, Pa.

[73] Assignee: Combustion Unlimited Incorporated, Jenkintown, Pa.

[21] Appl. No.: 928,298

[22] Filed: Jul. 26, 1978

Related U.S. Application Data

[63] Continuation of Ser. No. 769,869, Feb. 18, 1977, abandoned, which is a continuation-in-part of Ser. No. 559,492, Mar. 16, 1975, Pat. No. 4,070,146.

[51] Int. Cl.[2] ..... F23C 5/28

[52] U.S. Cl. ..... 431/202; 431/5; 431/174; 431/180

[58] Field of Search ..... 431/202, 5, 174, 175, 431/179, 285, 180, 185; 23/277 C

[56] References Cited

U.S. PATENT DOCUMENTS

| | | | |
|---|---|---|---|
| 3,822,985 | 7/1974 | Straitz | 431/284 |
| 3,933,420 | 1/1976 | Zink et al. | 431/202 |
| 4,087,235 | 5/1978 | Ito | 431/202 X |

*Attorney, Agent or Firm*—Zachary T. Wobernsmith, 2nd Zachary T. Wobernsmith, III

*Primary Examiner*—Edward G. Favors

[57] ABSTRACT

Burner heads for incinerating waste combustible gas from refineries and the like are disclosed, for use in flare gas burners wherein a plurality of waste gas burner heads are provided for simultaneous operation at the same level, which heads may be utilized in a ground flare, or utilized in an elevated version of a ground flare burner. The burner heads provide for efficient admixture of gas with air, do not plug up, have a low pressure drop, burn both low and high BTU gases, and provide for smokeless combustion.

5 Claims, 9 Drawing Figures

FIG. 5
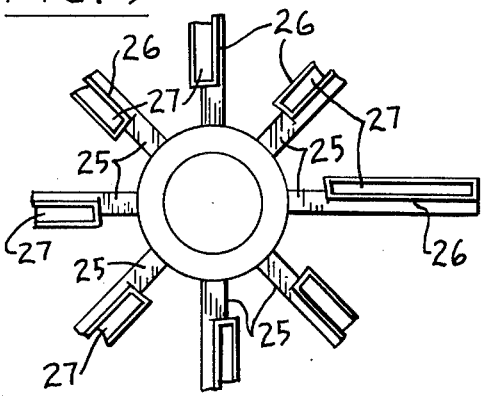
FIG. 4.
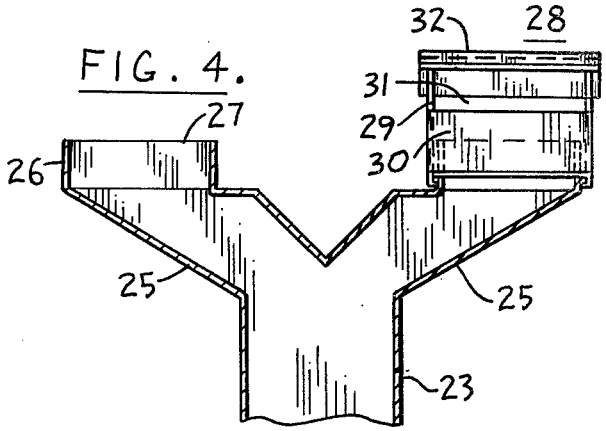
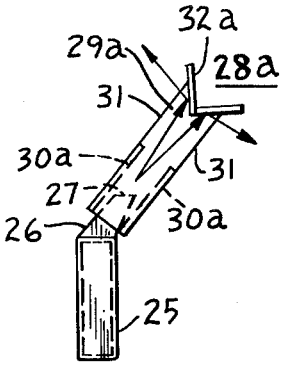
FIG. 8.
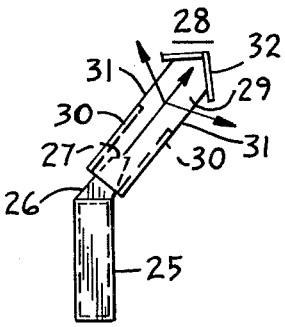
FIG. 7
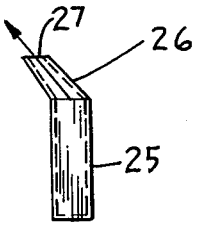
FIG. 6.
FIG. 9.
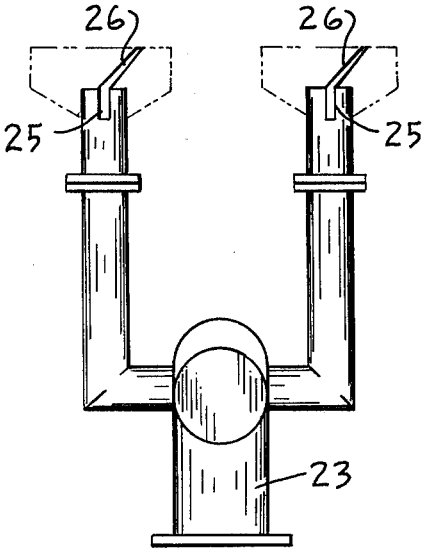

BURNER HEADS FOR WASTE COMBUSTIBLE GAS

This application is a continuation of my application Ser. No. 769,869 filed Feb. 18, 1977 abandoned which is a continuation in part of my prior application filed Mar. 16, 1975, Ser. No. 559,492 now U.S. Pat. No. 4,070,146.

BACKGROUND OF THE INVENTION

1. Field of the Invention

This invention relates to burner heads and more specifically to such heads utilized in apparatus for the combustion of combustible waste gas from refineries and the like.

2. Description of the Prior Art

It is common practice to use flare gas burners to burn waste gas from refineries and the like. One commonly used flare gas burner for this purpose includes a central gas pipe, surrounded by a large insulated cylinder containing burner heads therein which supply waste combustible gas for burning. The major objection to the available burner heads is that they concentrate gas being burned in one central area with inadequate surface area for mixing of air for efficient combustion with the gas. The surface area of the flare has a great effect upon diffusion of the gas and air, and this was not taken into account with many of the previously available burner heads. Waste gas diffusion is also dependent upon the Reynolds number, that is to say—whether it is a laminar or turbulent type of mixing.

The U.S. Pat. No. 2,971,605 to Frost et al. shows a method and apparatus for flaring combustible gaseous materials but the burner heads shown therein do not provide for sufficient admixture of air with gas for complete smokeless combustion.

While over the years, combustion can and has been inproved by using different types of burner heads, the burner heads heretofore and now employed are expensive and difficult to construct, do not provide for adequate mixing of air with the gas to be burned and often have maintenance problems aggravated by the variety of types of waste gas they are called upon to burn.

SUMMARY OF THE INVENTION

In accordance with the present invention, burner heads are provided for use in a flare gas burner for waste gas burning with a plurality of heads utilized for simultaneous operation, which burner heads may be utilized in a ground flare or in an elevated flare.

It is the principal object of the invention to provide improved burner heads for use in burning waste combustible gas which provides for highly effective gas air mixing for complete combustion and smokeless operation.

It is a further object of the invention to provide burner heads which operate at low and high BTU content gases levels and do not become plugged with carbon or other materials.

It is a further object of the invention to provide burner heads which have a low pressure drop.

It is a further object of the invention to provide burner heads that are simple to construct and enjoy a long service life.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which:

FIG. 4 is an enlarged vertical central sectional view of one preferred form of burner head employed in connection with the invention;

FIG. 5 is a fragmentary plan view of the burner head of FIG. 4;

FIG. 6 is a side elevational view of a combustible gas directing tip which is employed with the burner heads of FIGS. 4 and 5;

FIGS. 7 and 8 are side elevational views of attachments for use with the burner tip of FIGS. 4 and 5; and FIG. 9 is an end elevational view of the burner heads and the combustible gas supply piping therefor.

It should, of course, be understood that the description and drawings herein are illustrative merely and that various modifications and changes can be made in the structure without departing from the spirit of the invention.

Like numerals refer to like parts throughout the several views.

DESCRIPTION OF THE PREFERRED EMBODIMENTS

Figure 1:
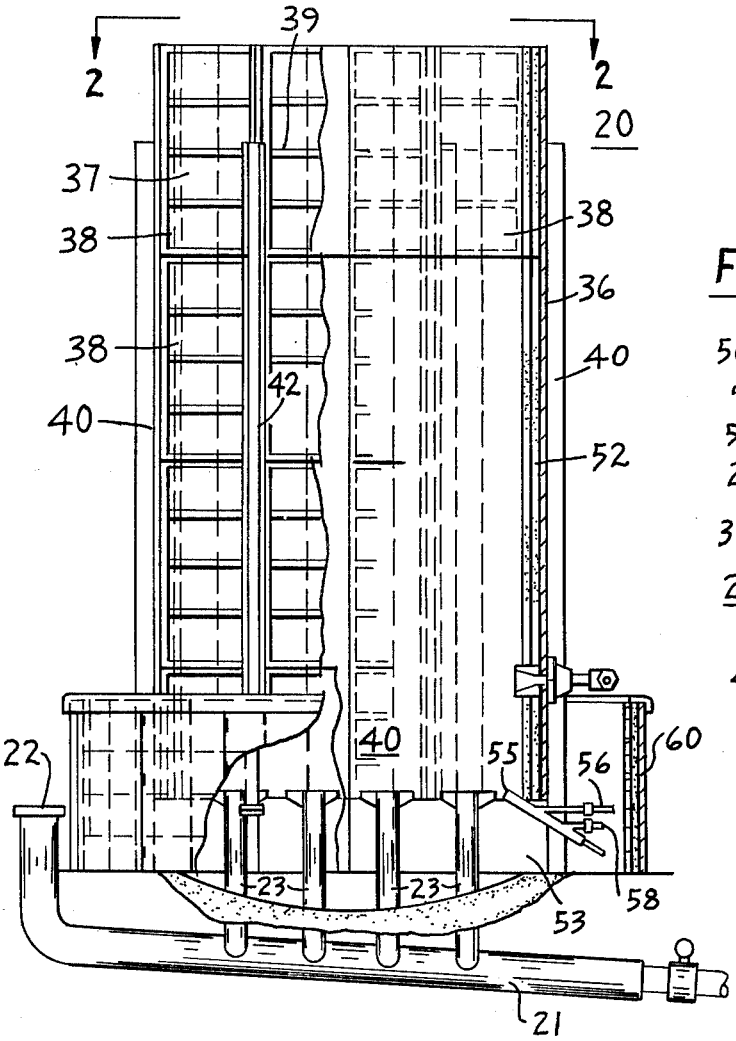
FIG. 1 is a view in elevation and as seen from one side of one form of flare burner for use on the ground and its associated components within which the burner heads of my invention are uitlized, parts being broken away to show the details of construction.
Figure 2:
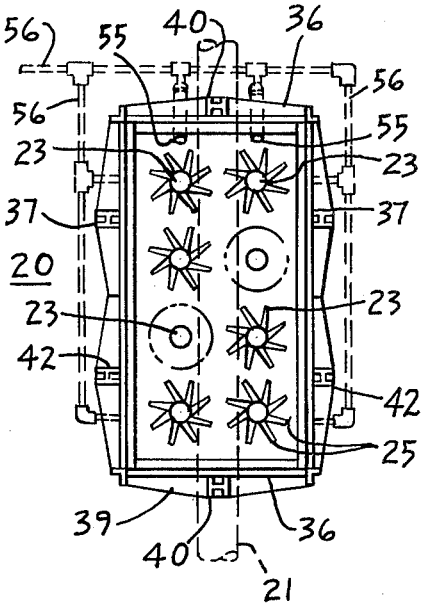
FIG. 2 is a horizontal sectional view, on a reduced scale, taken approximately on the line 2—2 of FIG. 1.

Referring now more particularly to the drawings, a flare burner of the ground flare type is shown generally at 20 with a combustible waste gas supply pipe 21 in communication therewith which in the form of the invention illustrated in FIGS. 1 and 2 is preferably buried beneath the ground a distance of the order of one or two feet for protection against the heat released by the combustion. The pipe 21 may extend above ground and be capped as at 22.

The pipe 21, at spaced locations therealong, has connected thereto spaced pairs of vertically extending gas delivery pipes 23. The pipes 23, at their upper ends have outwardly extending hollow horizontal vanes 25, tangentially as shown in FIGS. 1 and 2, or radially as shown in FIGS. 4, 5, and 9.

The vanes 25, as illustrated in FIGS. 6, 7, 8 and 9 have tilted converging tips 26 with upper slots 27 for discharge of gas in a vortex pattern for admixture with air for combustion.

While the vanes 25 with their converging tips 26 are satisfactory for some types of waste gas, greater turbulence of discharge of the waste gas and improved admixture of the burning gas and air and a better flame pattern can be achieved with the attachment 28 shown in FIGS. 4 and 7 mounted and retained on the tip 26.

The attachment 28 which fits over the end of tip 26 is of an open box-like configuration with end walls 29, and side walls 30 connecting the end walls 29. The side walls 30 are of a lesser height than the end walls 29 providing openings 31 for the combustible waste gas to escape for admixture with air and subsequent combustion. In FIG. 7, the attachment 28 has an inverted upper V shaped cap 32 with which the combustible gas is in contact and which directs the gas out the openings 31 in a sidewise pattern angularly directed with respect to the centerline through the tip 26.

In FIG. 8, in another embodiment of my invention, attachment 28*a* is illustrated which is also of an open box-like configuration similar to attachment 28 with end walls 29*a* and side walls 30*a*, also of a lesser height than end walls 29*a* forming openings 31*a* with the cap 32*a* to permit gas to escape for admixture with the air and subsequent combustion. The cap 32*a* is of V shape so that the combustible gas striking it is diverted outwardly in a generally perpendicular pattern with respect to the centerline of the tip 26.

Referring now more particularly to FIGS. 1 and 2, the vanes 25 are shown as disposed within a combustion chamber 35, preferably rectangular in horizontal cross section, which is open at the top, and enclosed within a plurality of vertical end walls 36 and side walls 37; as shown in detail in my prior application Ser. No. 559,492.

The end walls 36 are illustrated as composed of a plurality of horizontal extending upright panels 38 having spaced horizontal ribs 39 engaged with upright H beams 40 forming part of the supporting frame. The panels 38 have vertical end flanges (not shown).

The side walls 37 are similar to the end walls 36 except for the provision of a plurality of H beams 42 to provide the desired horizontal dimension. The side walls 37 have upright panels 38 with ribs 44.

The vertical end flanges (not shown) of the panels 38 of the end walls 36 and of the side walls 37 are secured to vertical angles (not shown) by bolts (not shown) while the vertical flanges of the panels 38 of the side walls 37 are held in assembled relation by bolts (not shown) extending therethrough, a fiber lining 52 is provided secured to the inner faces of panels 38 to provide for noise reduction and insulation.

The panels 38 of the walls 36 and 37 are terminated in spaced relation to the ground to provide air inlet openings 53 for induction of air for combustion and may be surrounded by a fence 60 which serves as a wind break and accoustical barrier.

A pilot 55 is provided having a gas supply pipe 56 connected thereto and an igniter pipe 58 for supplying a flame if required to light the pilot 55, providing ignition for the gas delivered through burner heads 28 and 28*a*.

The mode of operation will now be pointed out.

Figure 3:
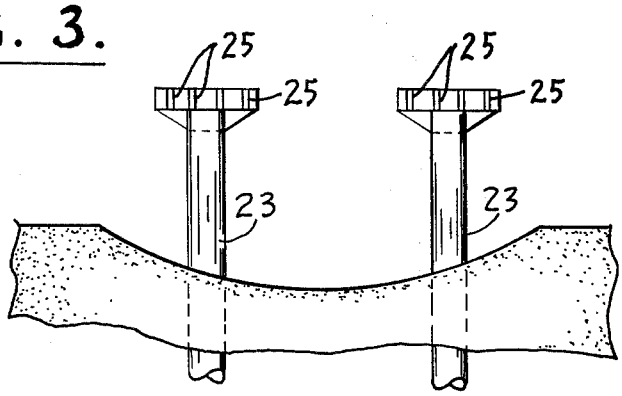
FIG. 3 is a fragmentary elevational view showing a pair of burner heads in accordance with the invention.

Combustible waste gas, which may be, but is not limited to, low BTU content and of relatively low pressure of the order of a few inches of water can be employed, the burner tips 26 as shown in FIGS. 3, 5, and 6 being particularly suitable for burning such gas at such pressures. The gas is supplied through the pipe 21 and the pipes 22 to the burner tips 26 where it exits, is mixed with air, and ignited by pilot 55.

The disposition of the burner tips 26 aids in providing turbulence while inducing air around the flat sheets of gas discharged through the slots 27 for combustion of the exiting gas.

The waste combustible gas may also contain small entrained liquid particles that are to be burned, and also at times difficulty may be encountered with slugs or plugs of liquid or of solid carbonaceous material which tend to clog other types of tips but which can successfully pass out of tips 26 to be burned.

The burner tips 26 with the attachments 28 or 28*a* shown in FIGS. 4, 7, and 8 are better suited for smokeless burning of gas having a high BTU content and provide greater turbulence and direct the waste gas through the slots 31 or 31*a* outwardly or transversely to a greater extent or at a flatter angle for contact with the air, induced by the flow.

It should be noted that due to the efficient mixing of gas with air by the tips 26, 28 or 28*a*, all of the waste gas is burned in the combustion chamber 35.

The delivery of the combustible waste gas through the pipe 21, the pipes 22 and the burner tips 26, without obstruction, is utilized to induce air through the air inlet openings 53 in addition to the natural draft in the combustion chamber 35 which supports effective combustion.

It is thus apparent that the combustible gas pattern induced by the tips 26, attachments 28 and 28*a* is such that greater quantities of the air are caused to mix therewith with the resultant combustion being more efficient and smokeless.

I claim:

1. Combustion apparatus for use in a flare gas burner for combustible waste gas comprising a combustion chamber open at the top and having its lower margin elevated for entry of air for combustion, a combustible waste gas supply connection, means at the bottom of said combustion chamber in communication with said supply connection comprising a plurality of spaced burner heads spaced above said waste gas supply connection and spaced above the lower margin of said combustion chamber, each of said burner heads having a plurality of outwardly extending tilted vanes with elongated slots for gas delivery, and said tilted vanes of said spaced burner heads being disposed to provide a plurality of spaced vortex mixing patterns within said combustion chamber and to which air for combustion is freely accessible from the space below said lower margin.

2. Combustion apparatus for use in a flare gas burner for combustible waste gas comprising a combustion chamber open at the top and having its lower margin elevated for entry of air for combustion, a combustible waste gas supply connection, means at the botton of said combustion chamber in communication with said supply connection comprising a plurality of open spaced burner heads spaced above said waste gas supply connection and each having a plurality of outwardly extending tilted vanes with elongated slots for gas delivery, and said tilted vanes of said spaced burner heads being disposed to provide a plurality of spaced vortex mixing patterns within said combustion chamber, said vanes having attachments thereon with diverting members disposed outwardly thereof and having elongated side slots extending along and in communication with said slots in said vanes.

3. Burner heads as defined in claim 1 in which vertical burner supply pipes are provided extending from said supply connection on the upper ends of which said burner heads are mounted.

4. Burner heads as defined in claim 2 in which said diverting members have V-shaped portions extending along and above the slots in said vanes.

5. Burner heads as defined in claim 4 in which said V-shaped diverting members are inverted.

* * * * *